US008150087B2

(12) United States Patent
Akino

(10) Patent No.: US 8,150,087 B2
(45) Date of Patent: Apr. 3, 2012

(54) BOUNDARY MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 247 days.

(21) Appl. No.: 12/659,710

(22) Filed: Mar. 18, 2010

(65) Prior Publication Data

US 2010/0246876 A1 Sep. 30, 2010

(30) Foreign Application Priority Data

Mar. 24, 2009 (JP) ..... 2009-071514

(51) Int. Cl.
*H04R 25/00* (2006.01)

(52) U.S. Cl. ..... 381/361; 381/174

(58) Field of Classification Search ..... 381/174, 381/355, 356, 361, 190–191, 91
See application file for complete search history.

(56) References Cited

U.S. PATENT DOCUMENTS 6,128,394 A * 10/2000 Hayakawa et al. ..... 381/386
7,409,234 B2 * 8/2008 Glezerman ..... 455/569.1
2010/0261499 A1 * 10/2010 Sip ..... 455/550.1

* cited by examiner

*Primary Examiner* — Davetta W Goins
*Assistant Examiner* — Phylesha Dabney
(74) *Attorney, Agent, or Firm* — Manabu Kanesaka

(57) ABSTRACT

There is provided a boundary microphone in which a microphone cover can be fixed to a base part without the use of an externally threaded screw for fixation. In the boundary microphone in which a condenser microphone unit 31 is housed in a microphone casing 1 including a flat base part 10 formed of a metallic magnetic material, the upper surface side of which is open, and a microphone cover 20 formed of a metallic magnetic material, which has many openings and covers the upper surface side of the base part 10, on either one of the base part 10 and the microphone cover 20, a permanent magnet 40 that magnetically attracts the other thereof is provided, and the microphone cover 20 is detachably fixed to the base part 10 by the permanent magnet 40.

3 Claims, 2 Drawing Sheets

BOUNDARY MICROPHONE

CROSS-REFERENCE TO RELATED APPLICATION

The present application is based on, and claims priority from, Japanese Application Serial Number JP2009-071514, filed Mar. 24, 2009, the disclosure of which is hereby incorporated by reference herein in its entirety.

TECHNICAL FIELD

The present invention relates to a boundary microphone used by being placed on a table or a floor surface. More particularly, it relates to a technique for preventing the generation of noise caused by extraneous electromagnetic waves.

BACKGROUND ART

A boundary microphone is also called a surface mount microphone because it is used by being placed on a table or a floor surface in a TV studio, a conference room, or the like. One example of the boundary microphone is shown in FIG. 5.

A microphone casing 1 for the boundary microphone is made up of two parts: a flat base part 10 the upper surface side of which is open, and a microphone cover 20 having many openings (sound wave introducing holes) that is attached to the base part 10 so as to cover the upper surface of the base part 10.

Usually, the base part 10 is formed by casting such as zinc die casting, and as the microphone cover 20, a punched plate (perforated plate) is used. In place of the punched plate, a wire mesh body is sometimes used.

The microphone cover 20 is screw-mounted to the base part 10. Screw-mounting at many points impairs the appearance of microphone; therefore, in many cases, the microphone cover 20 is screw-mounted to the base part 10 at one point.

That is, substantially in the center of the microphone cover 20, a screw insertion hole 21 is formed, and on the base part 10 side, a boss 11 having an internally threaded hole 12 is erectingly provided. By threadedly engaging an externally threaded screw 22 for fixation with the internally threaded hole 12 in the mating boss 11 through the screw insertion hole 21, the microphone cover 20 is fixed to the base part 10.

Thereby, a shielded space is formed in the microphone casing 1, and therein, a microphone unit 31 is housed in a state of being mounted on a circuit board 30. As the microphone unit 31, a condenser microphone unit is usually used.

On the circuit board 30, an impedance converter, a tone control circuit, an output circuit, and the like (all of these are not shown) are mounted. The circuit board 30 is connected with a microphone cord 32, and the microphone cord 32 is pulled out of the base part 10 via a cord bush 33.

The punched plate used for the microphone cover 20 is manufactured as follows: many holes are formed in, for example, a steel sheet, the steel sheet formed with many holes is cut into a predetermined size, and the cut steel sheet is fabricated into a target shape with a press. Since the punched plate is a plate formed with many holes, a peripheral edge part 20*a* (cutting face) of the microphone cover 20, which is in contact with the base part 10, is uneven and serrated.

In the case where the base part 10 is formed by die casting, the surface thereof is not smooth, so that the electrical connection between the base part 10 and the microphone cover 20 is made by point contact at many points. The interference caused by ordinary electromagnetic waves such as VHF or UHF band generally used at broadcasting stations and the like can be precluded sufficiently by the shield provided by the base part 10 and the microphone cover 20.

In recent years, countermeasures against the generation of noise caused by cellular phones that have come into wide use rapidly have been needed urgently. The use of a cellular phone produces considerably strong electromagnetic waves (for example, in the range of several centimeters to several tens centimeters, the field intensity reaches several ten thousands times the field intensity produced in the city by commercial electric waves). Therefore, the shield provided by the above-described point contact between the base part 10 and the microphone cover 20 is insufficient: if a cellular phone is used near a microphone, noise may be generated by the strong electromagnetic waves produced by the use of cellular phone.

To solve this problem, a technique has been disclosed in Japanese Patent Application Publication No. 2005-333180. In this technique, as shown in FIG. 5, a gasket 34 consisting of a conductive cloth or the like having both of elasticity and electric conductivity is put between the base part 10 and the peripheral edge part 20*a* of the microphone cover 20, whereby the shield provided by the base part 10 and the microphone cover 20 is made further reliable.

Unfortunately, this shield still has a problem as described below. Although the externally threaded screw 22 for fixing the microphone cover 20 is usually made of iron to assure the mechanical strength, the externally threaded screw 22 is painted, for example, in black from the viewpoint of design because the head of the externally threaded screw 22 is exposed to the outside. Also, the punched plate used as the microphone cover 20 is similarly painted, for example, in black.

Therefore, the electrical connection between the externally threaded screw 22 and the microphone casing 1 is unstable in view of high frequency. Also, since the externally threaded screw 22 penetrates the microphone cover 20 and gets into the microphone casing 1, electromagnetic waves may intrude into the microphone casing 1 with the externally threaded screw 22 serving as a magnetic core. Incidentally, it has been confirmed that when the externally threaded screw 22 is removed, the noise caused by electromagnetic waves reduces.

SUMMARY OF THE INVENTION

Accordingly, an object of the present invention is to provide a boundary microphone in which a microphone cover can be fixed to a base part without the use of an externally threaded screw.

To achieve the above object, the present invention provides a boundary microphone comprising a microphone casing including a flat base part formed of a metallic magnetic material, the upper surface side of which is open, and a microphone cover formed of a metallic magnetic material, which has many openings and covers the upper surface side of the base part, in which a condenser microphone unit is housed in the microphone casing, wherein on either one of the base part and the microphone cover, a permanent magnet that magnetically attracts the other thereof is provided, and the base part and the microphone cover are fixed to each other detachably by the permanent magnet.

According to a preferred mode of the present invention, a protrusion is erectingly provided in a substantially central portion of the base part so as to face to the inner surface of the microphone cover with a predetermined clearance being provided therebetween, and the permanent magnet is integrally fixed to the upper end surface of the protrusion.

Also, a gasket having both of elasticity and electric conductivity is disposed between the peripheral edge part of the microphone cover and the base part.

According to the present invention, since the microphone cover is fixed to the base part by the magnetic attraction force of the permanent magnet, the externally threaded screw for fixation and a screw insertion hole therefor are unnecessary, and accordingly the shielding ability against strong electromagnetic waves radiated from a cellular phone or the like can be enhanced further.

DETAILED DESCRIPTION

An embodiment of the present invention will now be described with reference to the accompanying drawings. The present invention is not limited to this embodiment. In the description of this embodiment, the same symbols are applied to elements that are the same as those of the conventional boundary microphone explained before with reference to FIG. 5.

Figure 1:
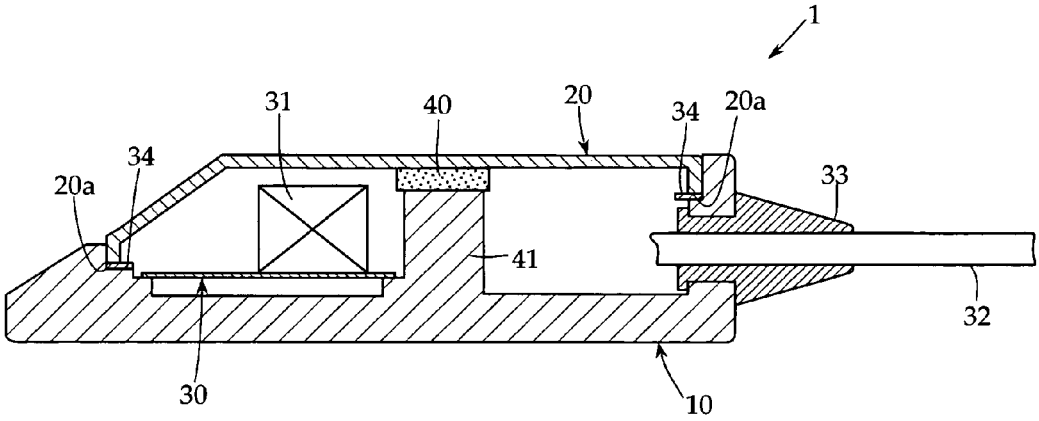
FIG. 1 is a sectional view of a boundary microphone in accordance with one embodiment of the present invention.

As shown in FIG. 1, a microphone casing 1 for a boundary microphone of the present invention is basically made up of two parts: a flat base part 10 formed of a metallic magnetic material, the upper surface side of which is open, and a microphone cover 20 formed of a metallic magnetic material having many openings (sound wave introducing holes), which is fixed to the base part 10 so as to cover the upper surface side of the base part 10.

The base part 10 is formed by casting such as zinc die casting. Aside from this, a press molded product of, for example, an iron plate may be used as the base part 10. As the microphone cover 20, a punched plate (perforated plate) made of iron or the like is used. In place of the punched plate, a wire mesh body (a card mesh consisting of steel wires) may be used.

In the microphone casing 1, that is, in a shielded space formed by the base part 10 and the microphone cover 20, a condenser microphone unit 31 is housed in a state of being mounted on a circuit board 31. Aside from this, the condenser microphone unit 31 may be placed on the base part 10 via a suitable elastic sheet, and be fixed with a fixing band or the like.

On the circuit board 30, a tone control circuit, an impedance converter, an output circuit, and the like (all of these are not shown) are mounted. The circuit board 30 is connected with one end side of a microphone cord 32, and the other end side of the microphone cord 32 is pulled out of the microphone casing 1 via a cord bush 33.

In fixing the microphone cover 20 to the base part 10, in the present invention, a permanent magnet 40 is used. That is, both of the base part 10 and the microphone cover 20 are formed of a metallic magnetic material, and the base part 10 and the microphone cover 20 are fixed to each other by the magnetic attraction force of the permanent magnet 40. The base part 10 and the microphone cover 20 can easily be attached to and detached from each other because they are fixed to each other by the permanent magnet 40.

The permanent magnet 40 may be provided on either one of the base part 10 and the microphone cover 20. Alternatively, the permanent magnet 40 may be provided on both of the base part 10 and the microphone cover 20 providing that the unlike poles thereof face to each other.

In this embodiment, in the substantially central portion of the base part 10, a columnar protrusion 41 is erectingly provided at a position corresponding to that of the boss 11 in the conventional example described with reference to FIG. 5. To the upper end surface of the protrusion 41, the permanent magnet 40 is fixed via an adhesive or the like.

Figure 5:
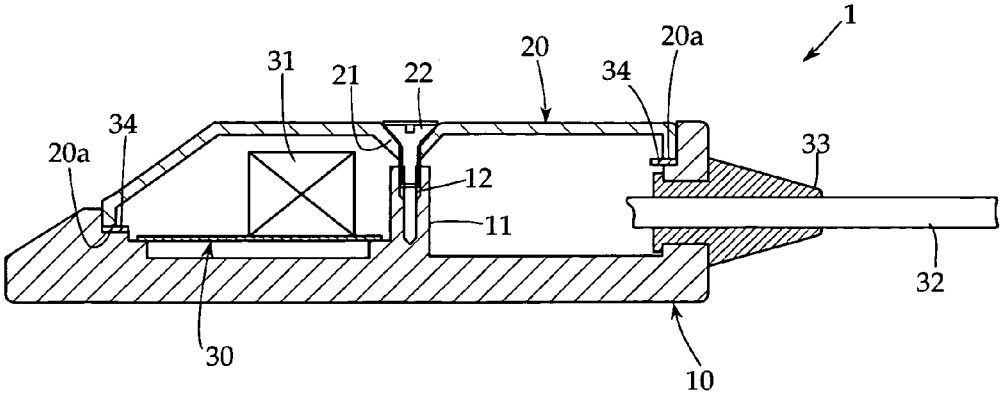
FIG. 5 RELATED ART
FIG. 5 is a sectional view of a conventional boundary microphone.

According to this configuration, since the microphone cover 20 is fixed to the base part 10 by the magnetic attraction force of the permanent magnet 40, the externally threaded screw 22 for fixation and the screw insertion hole 21 described with reference to FIG. 5 are unnecessary. Accordingly, the shielding ability is enhanced, and also the appearance of microphone is improved.

Since the microphone cover 20 is formed by a punched plate or a wire mesh body, a peripheral edge part 20*a* of the microphone cover 20, which is in contact with the base part 10, is uneven and serrated. Therefore, to enhance the shielding ability against strong electromagnetic waves radiated especially from a cellular phone, it is preferable that a gasket 34 consisting of a conductive cloth or the like having both of elasticity and electric conductivity be put between the mating faces of the microphone cover 20 and the base part 10.

According to the present invention, since the microphone cover 20 can be removed from the base part 10 relatively easily, the painting colors of the base part 10 and the microphone cover 20 can be changed easily so as to be fit for the installation location and the like. One example of the procedure therefor is explained with reference to FIGS. 2 to 4.

Figure 2:
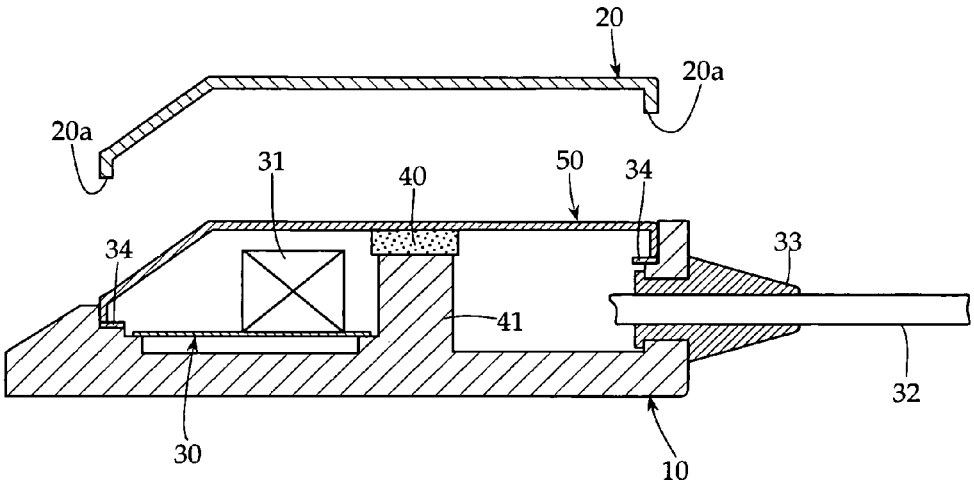
FIG. 2 is a sectional view showing a preparation procedure at the time when the boundary microphone shown in FIG. 1 is repainted.

First, as shown in FIG. 2, the microphone cover 20 is removed, and a painting mask 50 is put on the base part 10 that is in the state in which the upper surface side thereof is open.

The painting mask 50 is preferably formed of a metallic magnetic material that is magnetically attracted by the permanent magnet 40 so as not to be shifted easily by vibrations, shocks, or the like. However, the painting mask 50 may be formed of any other material as far as it can be fixed to the base part 10.

Figure 3:
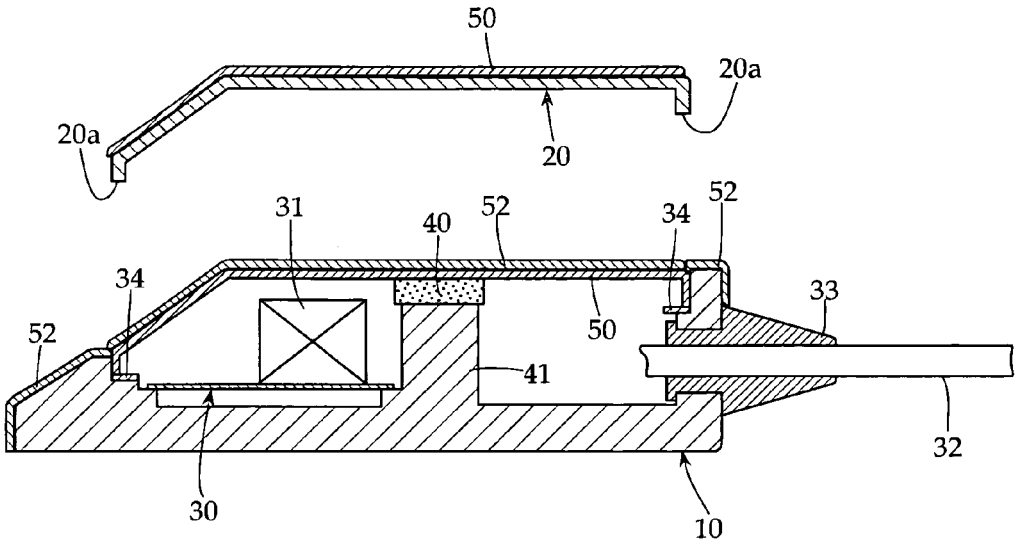
FIG. 3 is an exploded sectional view showing a state in which a base part and a microphone cover of the boundary microphone shown in FIG. 1 have been painted.

As shown in FIG. 3, a paint film 51 of a predetermined color is built up on the microphone cover 20, and also a paint film 52 of a different color is built up on the base part 10 by spray painting or the like. In FIG. 3, the paint film 52 is built up on the whole surface of the painting mask 50. In the actual painting work, however, the paint film 52 is built up mainly in the peripheral edge part of the base part 10.

Figure 4:
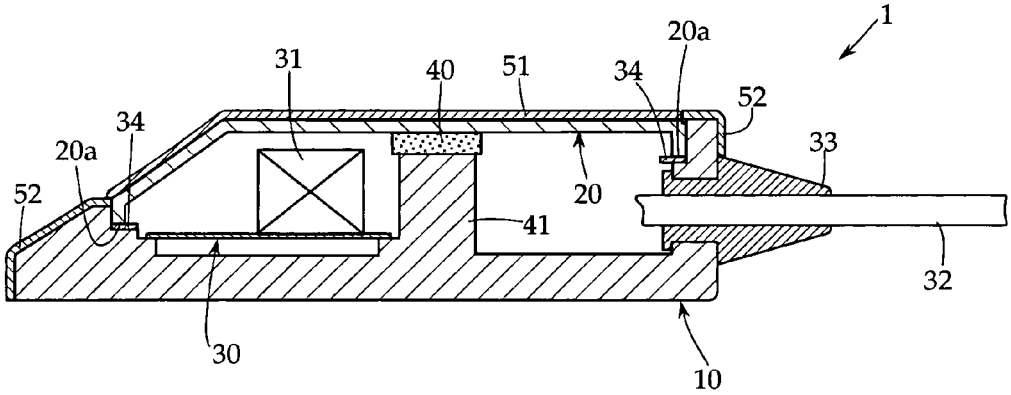
FIG. 4 is a sectional view for explaining a method for assembling after painting.

After the paint films 51 and 52 have dried, the painting mask 50 is removed from the base part 10, and as shown in FIG. 4, the separately painted microphone cover 20 is fixed to the base part 10. Thus, the base part 10 and the microphone cover 20 can be painted a desired color easily.

In the above-described embodiment, the columnar protrusion 41 is erected in the substantially central portion of the base part 10, and the permanent magnet 40 is disposed thereon. However, in order to make the fixation due to the magnetic attraction force more reliable and to enhance the shielding ability, in place of the gasket 34, a band-like magnet rubber, which is provided, for example, on the door of an electric refrigerator, can be disposed between the mating faces of the microphone cover 20 and the base part 10.

As described above, according to the present invention, since the externally threaded screw for fixing the microphone cover 20 to the base part 10 is unnecessary, the shielding ability of the microphone casing can be enhanced further. Also, the base part 10 and the microphone cover 20 can be painted a desired color easily.

The invention claimed is:

1. A boundary microphone comprising a microphone casing including a flat base part formed of a metallic magnetic material, the upper surface side of which is open, and a microphone cover formed of a metallic magnetic material, which has many openings and covers the upper surface side of the base part, in which a condenser microphone unit is housed in the microphone casing, wherein on either one of the base part and the microphone cover, a permanent magnet that magnetically attracts the other thereof is provided, and the base part and the microphone cover are fixed to each other detachably by the permanent magnet.

2. The boundary microphone according to claim 1, wherein a protrusion is erectingly provided in a substantially central portion of the base part so as to face to the inner surface of the microphone cover with a predetermined clearance being provided therebetween, and the permanent magnet is integrally fixed to the upper end surface of the protrusion.

3. The boundary microphone according to claim 1, wherein a gasket having both of elasticity and electric conductivity is disposed between the peripheral edge part of the microphone cover and the base part.

* * * * *